US007097601B1

(12) United States Patent
Ronnow

(10) Patent No.: US 7,097,601 B1
(45) Date of Patent: Aug. 29, 2006

(54) EXERCISE DEVICE

(76) Inventor: Clark Ronnow, 802B W. Maryland, Phoenix, AZ (US) 85013

( * ) Notice: Subject to any disclaimer, the term of this patent is extended or adjusted under 35 U.S.C. 154(b) by 0 days.

(21) Appl. No.: 10/997,499

(22) Filed: Nov. 24, 2004

Related U.S. Application Data

(60) Provisional application No. 60/525,529, filed on Nov. 26, 2003.

(51) Int. Cl.
*A63B 21/072* (2006.01)
*A63B 71/00* (2006.01)

(52) U.S. Cl. ..... 482/106; 482/139

(58) Field of Classification Search ..... 482/106–109, 482/139, 47–50, 93, 92; D21/673–676
See application file for complete search history.

(56) References Cited

U.S. PATENT DOCUMENTS

| | | | | |
|---|---|---|---|---|
| 1,422,888 | A | 7/1922 | Reeves et al. | |
| 3,290,044 | A | 12/1966 | Krodsen et al. | |
| 4,018,442 | A | 4/1977 | Galler | |
| D261,788 | S | 11/1981 | Burns | |
| 4,345,756 | A * | 8/1982 | Hoagland | 482/109 |
| 4,360,198 | A | 11/1982 | Waulters | |
| 4,986,535 | A | 1/1991 | Hull et al. | |
| 5,076,578 | A * | 12/1991 | Askonen | 482/139 |
| 5,435,800 | A | 7/1995 | Nelson | |
| 5,735,779 | A | 4/1998 | Lay | |
| 6,149,558 | A | 11/2000 | Chen | |
| 2004/0063553 | A1 * | 4/2004 | Viscount | 482/107 |

* cited by examiner

*Primary Examiner*—Gregory L. Huson
*Assistant Examiner*—Fenn C. Mathew
(74) *Attorney, Agent, or Firm*—Booth Udall, PLC

(57) ABSTRACT

An exercise device is described. The exercise device may include a pair of separate weightlifting units removably coupled to one another. Some implementations may include one or more of the following. Each weightlifting unit may include at least one weight removably held internal to the exercise device. The at least one weight may be coupled to one of a weight bar, a weight bar threaded along at least a portion of its length, and a weight bar having a plurality of spaced apart holes there through along at least a portion of its length. The at least one weight may be held in place by one of a spring clamp, a pressure ring collar, an adjustable nut, and a pin. The adjustable nut may be an annularly cylindrical nut having threads on an inner concentric surface and diamond knurl on an outer concentric surface.

9 Claims, 5 Drawing Sheets

EXERCISE DEVICE

CROSS REFERENCE TO RELATED APPLICATION

This application claims priority to the U.S. Provisional Patent Application to Clark Ronnow entitled "EXERCISE DEVICE," Ser. No. 60/525,529, filed Nov. 26, 2003, now pending, the disclosure of which is hereby incorporated entirely herein by reference.

BACKGROUND

1. Technical Field

This document relates to an exercise device.

2. Background Art

Although conventional exercise devices exist, many do not imitate normal work routines such as lifting and stretching to place bags, boxes, and the like on shelves, in the trunk of cars, on trucks, and the like when they are used. Furthermore, many conventional exercise devices are poorly balanced, unsafe, too inconvenient, too intimidating to make them user friendly, and/or too expensive to make them available to the public in general. Moreover, many of these conventional exercise devices are not ergonomically correct.

SUMMARY

In an aspect, this document features an exercise device and method for exercising. The exercise device may include a pair of separate weightlifting units removably coupled to one another.

Implementations may include one or more of the following. The pair of separate weightlifting units removably coupled to one another may have an overall rectangular shape. Each weightlifting unit may include at least one weight removably held internal to the exercise device. The at least one weight may be coupled to one of a weight bar, a weight bar threaded along at least a portion of its length, and a weight bar having a plurality of spaced apart holes there through along at least a portion of its length. The at least one weight may be held in place by one of a spring clamp, a pressure ring collar, an adjustable nut, and a pin. The adjustable nut may be an annularly cylindrical nut having threads on an inner concentric surface and diamond knurl on an outer concentric surface. Each weightlifting unit may include: an outer crossbar configured to serve as a handle; an inner crossbar; a pair of end bars maintained in a spaced apart, opposing relationship by the outer and inner crossbars; a weight arm comprised of one of a weight bar, a weight bar threaded along at least a portion of its length, and a weight bar having a plurality of spaced apart holes there through along at least a portion of its length, the weight arm configured to removably hold at least one weight thereon internal to the exercise device, and the weight arm extending orthogonally from the inner crossbar; and at least one weight removably held internal to the exercise device by the weight arm. The outer cross bar, the inner cross bar, the pair of end bars, and the weight arm may be one of coupled together, integrally joined together into a unitary framework, and a combination thereof. The outer cross bar, the inner cross bar, the pair of end bars, and the weight arm may be removably coupled together. The outer crossbar may have central, threaded apertures defined in opposing ends thereof. The inner crossbar may have central, threaded apertures defined in opposing ends thereof, as well as a through hole defined in the middle thereof. The first end bar may have a pair of spaced apart through holes defined in an end portion thereof. The second opposing end bar may have a pair of spaced apart through holes defined in an end portion thereof. The weight arm may have a central, threaded aperture defined in an end thereof. The at least one weight may have a central through aperture. The first end bar may have a central threaded aperture defined in an opposing end thereof and the second opposing end bar may have a central alignment aperture defined in an opposing end thereof, as well as one of a threaded through hole in communication with the central alignment aperture and a hole in communication with the central alignment aperture. An alignment pin may be included having a threaded base inserted into the central threaded aperture of the first end bar and one of a tapered body having a circumferential recess therein and a non-tapered body having a circumferential recess therein. A winged bolt may be inserted into the threaded through hole in communication with the central alignment aperture. A ball and spring assembly may be disposed within the hole in communication with the central alignment aperture, wherein a spring of the assembly may be resilient and bias a ball of the assembly into the central alignment aperture. The outer cross bar may have thereon one of a soft grip overlay, a rotatable sleeve, and a combination thereof.

The foregoing and other aspects, features, and advantages will be apparent from the DESCRIPTION and DRAWINGS, and from the CLAIMS.

BRIEF DESCRIPTION OF THE DRAWINGS

Implementations will hereinafter be described in conjunction with the appended DRAWINGS, where like designations denote like elements.

DESCRIPTION

1. Structure

Figure 1:
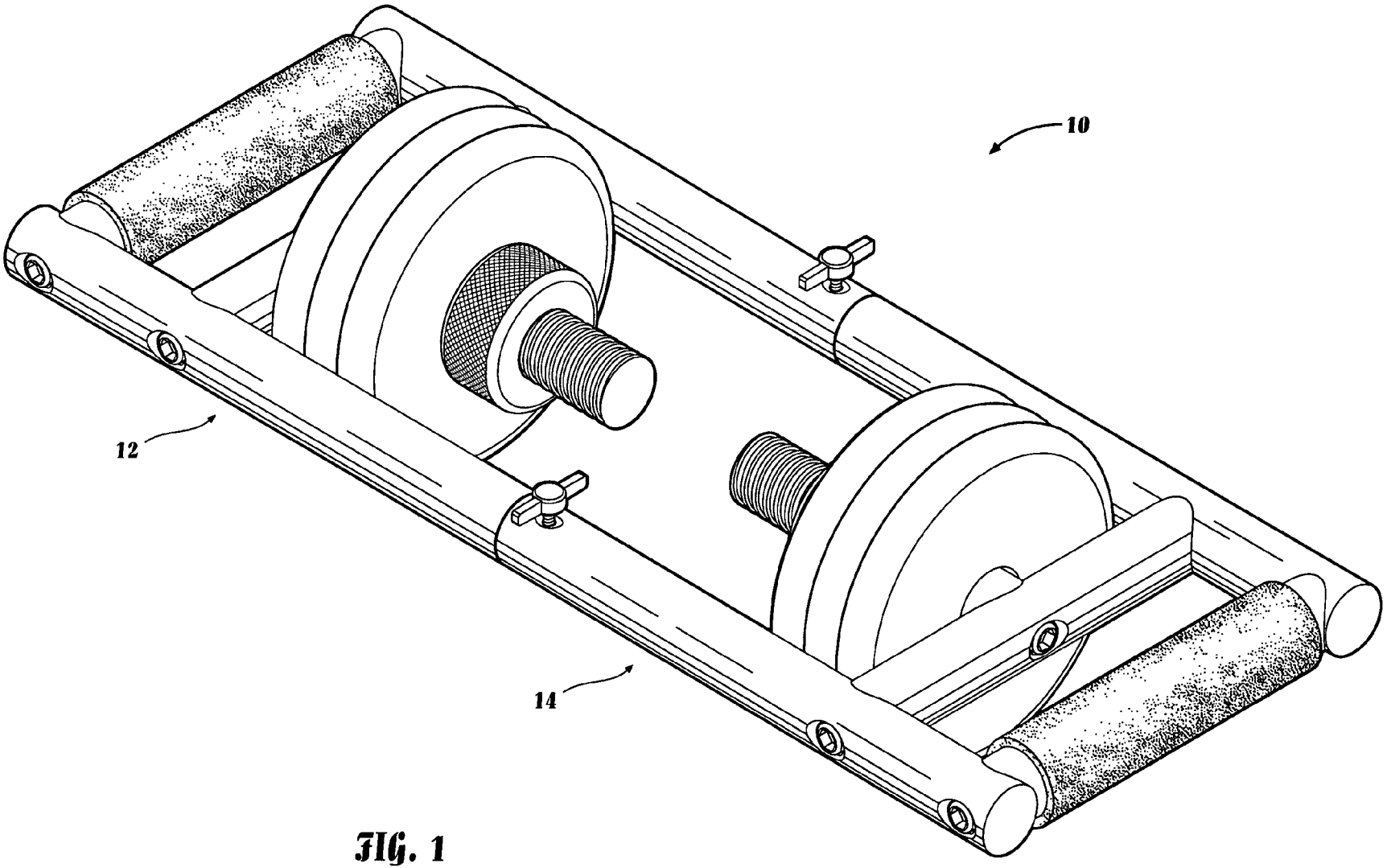
FIG. 1 is a perspective view of an exercise device implementation.

There are a variety of exercise device implementations. Notwithstanding, with reference to FIGS. 1–3 and for the exemplary purposes of this disclosure, exercise device 10 is an example of an exercise device implementation. The framework of exercise device 10 may be may be configured to come apart if desired to provide two, separate weightlifting units 12 and 14. Weightlifting unit 12 and weightlifting unit 14 may be identical and each may include outer crossbar 16, inner crossbar 22, end bar 28, end bar 36, threaded weight bar 46, alignment pin 50, wing bolt 52, bolts 54, weights 56, and weight nut 60.

Outer crossbar 16 may be a solid, cylindrical, bar configured to serve as a handle. Outer crossbar 16 may have central, threaded apertures 18 defined in opposing ends thereof. Outer crossbar 16 may also have slip resistant, cushioning, soft grip overlay 20. Inner crossbar 22 may be a solid, cylindrical, bar. Inner crossbar 22 may have central, threaded apertures 24 defined in opposing ends thereof, as well as latitudinal through hole 26 defined in the middle thereof.

End bars 28 and 36 may each be solid, cylindrical, bars and are maintained in a spaced apart relationship by outer and inner crossbars 16 and 22. End bar 28 may have a pair of spaced apart latitudinal through holes 32 and 34 defined in an end portion thereof, as well as central, threaded aperture 30 defined in an opposing end thereof. End bar 36 may have a pair of spaced apart latitudinal through holes 42 and 44 defined in an end portion thereof. End bar 36 may also have central alignment aperture 38 defined in an opposing end thereof, as well as latitudinal, threaded, through hole 40 defined through one wall in the opposing end portion thereof in communication with central aperture 38.

Threaded weight bar 46 may be configured to removably hold a plurality of weights 56 thereon internal to exercise device 10, as opposed to external, as well as to receive adjustable, threaded weight nut 60 to removably hold weights 56 in place. Threaded weight bar 46 may be a solid, cylindrical bar that may be threaded along at least a portion of its length. Threaded weight bar 46 may also have central, threaded aperture 48 defined in an end thereof.

Alignment pin 50 may be configured to removably insert into alignment aperture 38. Alignment pin 50 may have a threaded base and a tapered body having a circumferential recess therein.

Weights 56 may be disc shaped having central through aperture 58 for removably receiving there through threaded weight bar 46. Weight nut 60 may be annularly cylindrical in shape having threads on its inner concentric surface configured to adjust along threaded weight bar 46 to removably hold weights 56 in place, as well as diamond knurl on its outer concentric surface configured to provide a gripping surface for the hand/fingers of an exerciser.

2. Other Implementations

As mentioned earlier, many additional exercise device implementations are possible.

Figure 4:
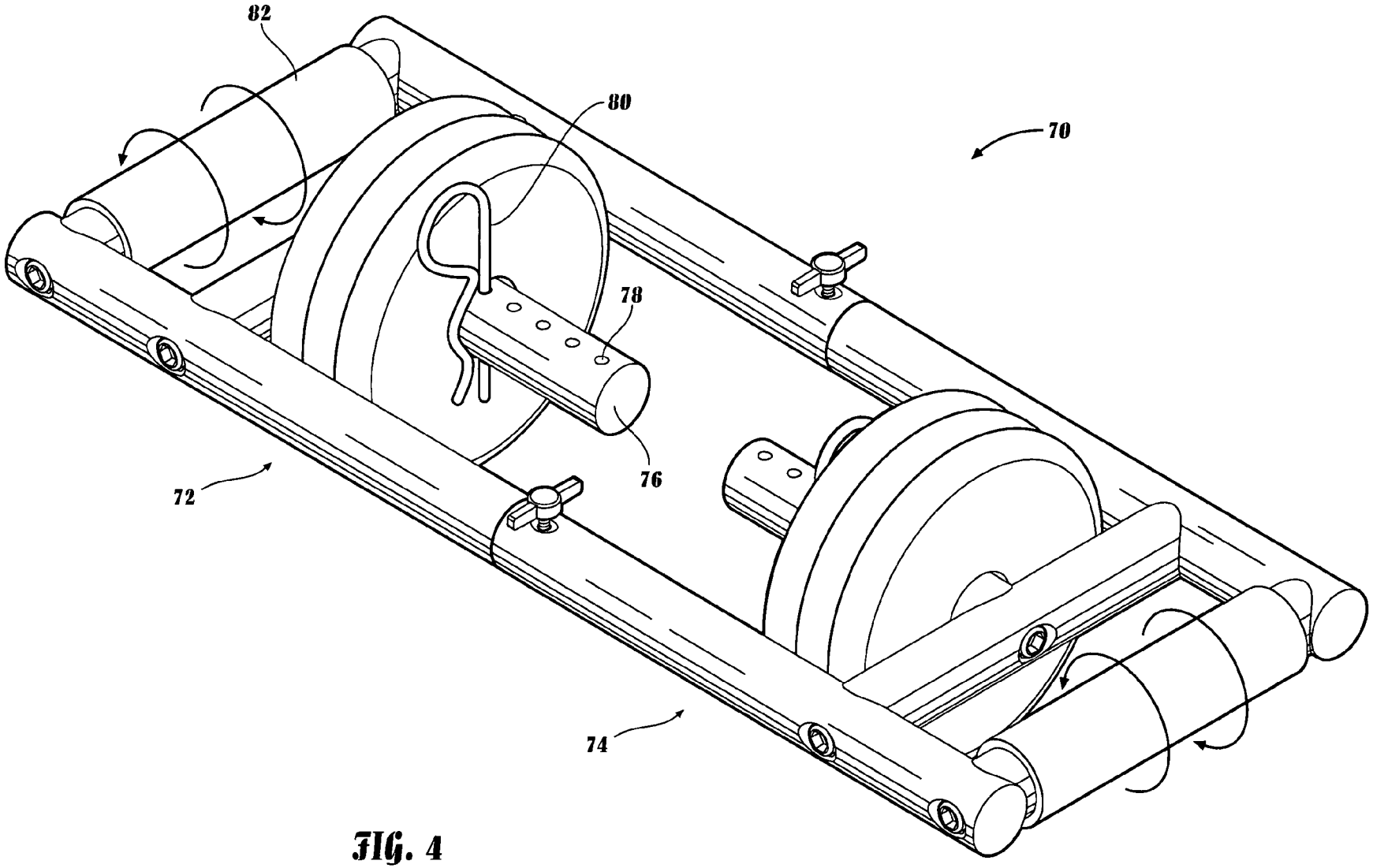
FIG. 4 is a perspective view of another exercise device implementation.

Although there are a variety of exercise device implementations, for the exemplary purposes of this disclosure and referring to FIG. 4, exercise device 70 is an example of an exercise device implementation. Exercise device 70 is substantially similar to exercise device 10 as previously described. The principal differences between them relates to their weight arms and the use of a rotatable sleeve. In particular, exercise device 70 may include a pair of units 72 and 74. Units 72 and 74 may include outer cross bars 16 which may include rotatable sleeves 82 thereon. Rotatable sleeves 82 are configured to allow an exerciser's hands to more easily move/adjust during exercises. Units 72 and 74 may include may also include weight bars 76 which may each comprise a series of spaced apart, latitudinal through holes 78 there through positioned longitudinally along weight bars 76. Holes 76 may be configured to receive cotter pin 80 for example to hold weights 56 in place.

Although there are a variety of exercise device implementations, for the exemplary purposes of this disclosure and referring to FIG. 4, unit 90 of an exercise device is an example of one unit of an exercise device implementation. Unit 90 is substantially similar to units 12 and 14 of exercise device 10 as previously described. The principal difference between them relates to their frameworks. In particular, unit 90 may include outer cross bar 92, inner cross bar 94, end bar 96, end bar 100, weight bar 106 which are integrally joined to one another in a unitary framework. Alignment pin 98 is similar to alignment pin 50, but is not tapered. Weight bar 106 may be configured to receive spring clamp 108 or a pressure ring collar with a T-bolt and the like for example thereon to hold weights 56 in place. Also, instead of wing bolt 52, ball and spring assembly 104 may be included. Ball and spring assembly 104 may be disposed within a hole in communication with the central alignment aperture. The spring is resilient and configured to bias the ball into central alignment aperture 102 in an engaged position with the recess of pin 98 when pin 98 is inserted into a corresponding hole 102. Accordingly, as pin 98 is removably inserted into a corresponding hole 102, pin 98 forces the ball to compress the spring until the ball is aligned with the recess in pin 98, at which point the spring forces the ball to engage the recess in pin 98.

Although there are a variety of exercise device implementations, for the exemplary purposes of this disclosure, another exercise device implementation may include for each unit two, parallel, spaced apart, weight bars coupled to an inner crossbar, the weight bars extending inwardly and perpendicularly there from, the weight bars and the inner crossbar comprising an overall U-shape. The weights may be rectangular in shape with either two opposing through apertures at each end portion of each weight for removably receiving there through the spaced apart, weight bars, or two opposing notches in each end of each weight for removably receiving there in the spaced apart, weight bars.

Further implementations are within the CLAIMS.

3. Specifications, Materials, Manufacture, and Assembly

It will be understood that exercise device implementations are not limited to the specific devices and components disclosed herein, as virtually any devices and components consistent with the intended operation of an exercise device implementation may be utilized. Accordingly, for example, although particular exercise devices, units, bars, pins, clamps, collars, holes, bolts, nuts, threads, sleeves, overlays, weights, balls, springs, and other components are disclosed, such components may comprise any shape, size, style, type, model, version, class, measurement, concentration, material, weight, quantity, and/or the like consistent with the intended operation of an exercise device implementation. Implementations are not limited to uses of any specific components, provided that the components selected are consistent with the intended operation of an exercise device implementation.

Accordingly, the components defining any exercise device implementation may be formed of any of many different types of materials or combinations thereof that can readily be formed into shaped objects provided that the components selected are consistent with the intended operation of an exercise device implementation. For example, the components may be formed of: rubbers (synthetic and/or natural); glasses, such as fiberglass, carbon-fiber, aramid-fiber, and/or other like materials; polymers such as plastic, polycarbonate, PVC plastic, ABS plastic, polystyrene, polypropylene, nylon, any combination thereof, and/or other like materials; metals, such as zinc, magnesium, titanium, copper, iron, steel, stainless steel, any combination thereof, and/or other like materials; alloys, such as aluminum, and/or other like materials; any other suitable material; and/or any combination thereof.

Thus, for the exemplary purposes of this disclosure, mounting device 10 may comprise a balanced, symmetrical, rectangular, overall shape that may have a length of approximately 17.800 inches±0.010 and a width of approximately 7.250 inches±0.010. Outer crossbar 16, inner crossbar 22, end bar 28, end bar 36, and threaded weight bar 46 may be formed from approximately 0.875 inch to approximately 1.000 inch±0.010 diameter aluminum bars. Outer crossbar 16 and inner crossbar 22 may both be approximately 5.250 inches±0.010 in length. Central, threaded apertures 18 and 24 defined in opposing ends of outer crossbar 16 and inner crossbar 22 respectively may each have a diameter of approximately 0.257 inches±0.010, approximately 18 threads per inch (course threads), and a depth of approximately 1.292 inches±0.010. Through hole 26 defined in the middle of inner crossbar 22 may have a diameter of approximately 0.323 inches±0.010 and a countersink having a diameter of approximately 0.531 inches±0.010 at a depth of approximately 0.373 inches±0.010. End bars 28 and 36 may both be approximately 8.900 inches±0.010 in length. The pair of spaced apart through holes 32 and 34 defined in an end portion of end bar 28 may each have a diameter of approximately 0.323 inches±0.010 and a countersink having a diameter of approximately 0.531 inches±0.010 at a depth of approximately 0.373 inches±0.010. Central threaded aperture 30 defined in an opposing end of end bar 28 may have a diameter of approximately 0.313 inches±0.010, approximately 16 threads per inch (course threads), and a depth of approximately 1.188 inches±0.010. The pair of spaced apart through holes 42 and 44 defined in an end portion of end bar 36 may each have a diameter of approximately 0.323 inches±0.010 and a countersink having a diameter of approximately 0.531 inches±0.010 at a depth of approximately 0.373 inches±0.010. Central alignment aperture 38 defined in an opposing end of end bar 36 may have a diameter of approximately 0.375 inches±0.010 and a depth of approximately 1.000 inches±0.010. Threaded through hole 40 defined through one wall in the opposing end portion of end bar 36 in communication with central aperture 38 may have a diameter of approximately 0.201 inches±0.010 and approximately 20 threads per inch (course threads). Threaded weight bar 46 may be approximately 4.400 inches±0.010 in length having course threads along approximately 3.775 inches±0.010 of its length. Central threaded aperture 48 defined in an end of threaded weight bar 46 may have a diameter of approximately 0.257 inches±0.010, approximately 18 threads per inch (course threads), and a depth of approximately 1.291 inches±0.010. Alignment pin 50 may be approximately 1.300 inches±0.010 in length. Weight nut 60 may be approximately 1.000 inches±0.010 in length. The outer concentric surface of weight nut 60 may have a diameter of approximately 2.000 inches±0.010, while the inner concentric threaded surface may have a diameter of approximately 1.000 inch±0.010 with approximately 8 threads per inch (course double start ACME threads).

Furthermore, the components defining any exercise device implementation may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, milling, stamping, cutting, welding, soldering, riveting, punching, and/or the like. If any of the components are manufactured separately, they may then be coupled with one another in any manner, such as with adhesive, a weld, a fastener (e.g. a bolt, a nut, a screw, a nail, a rivet, a pin, and the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Figure 2:
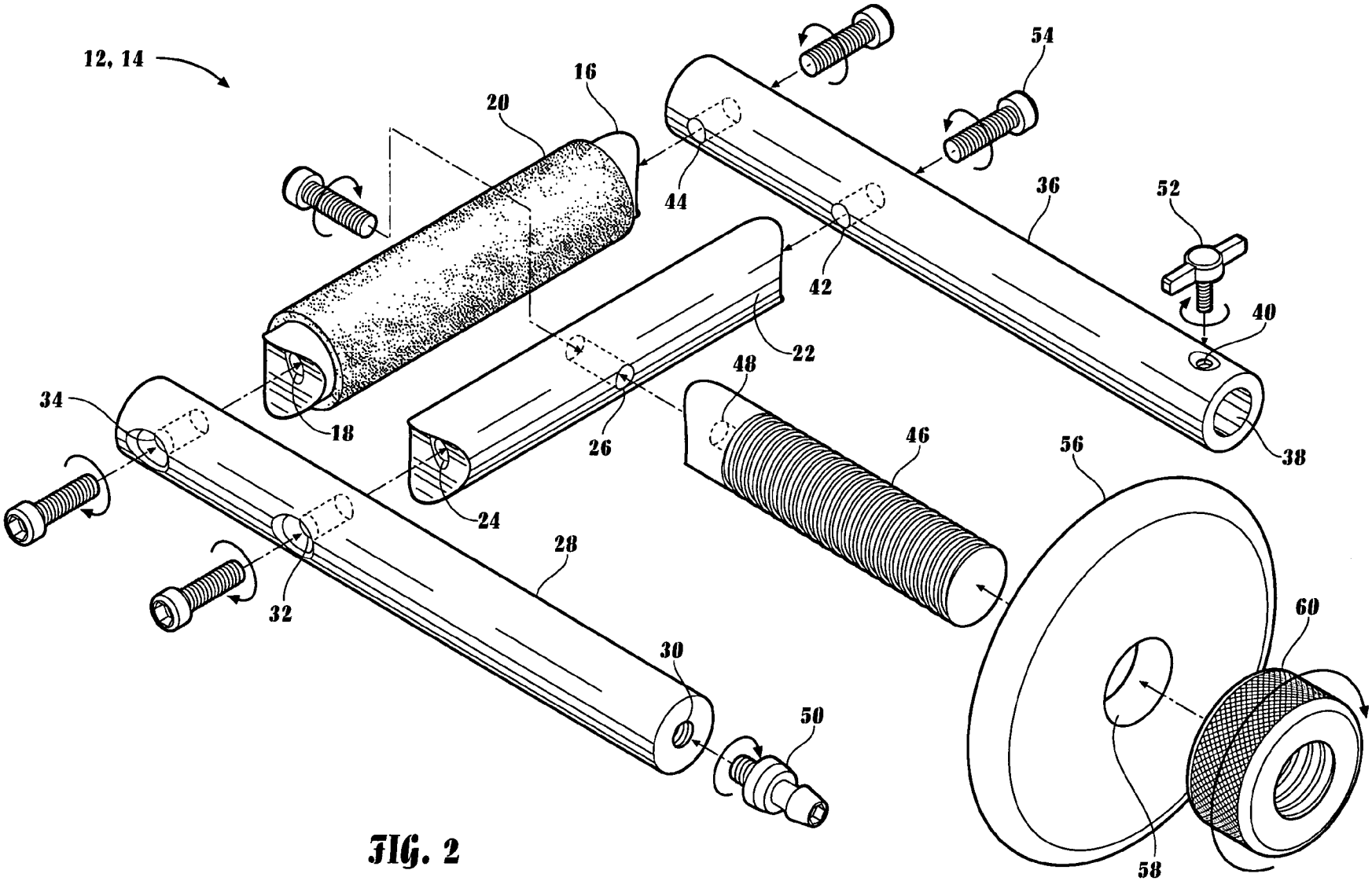
FIG. 2 is an exploded perspective view of one unit of the exercise device of FIG. 1 during assembly thereof.
Figure 3:
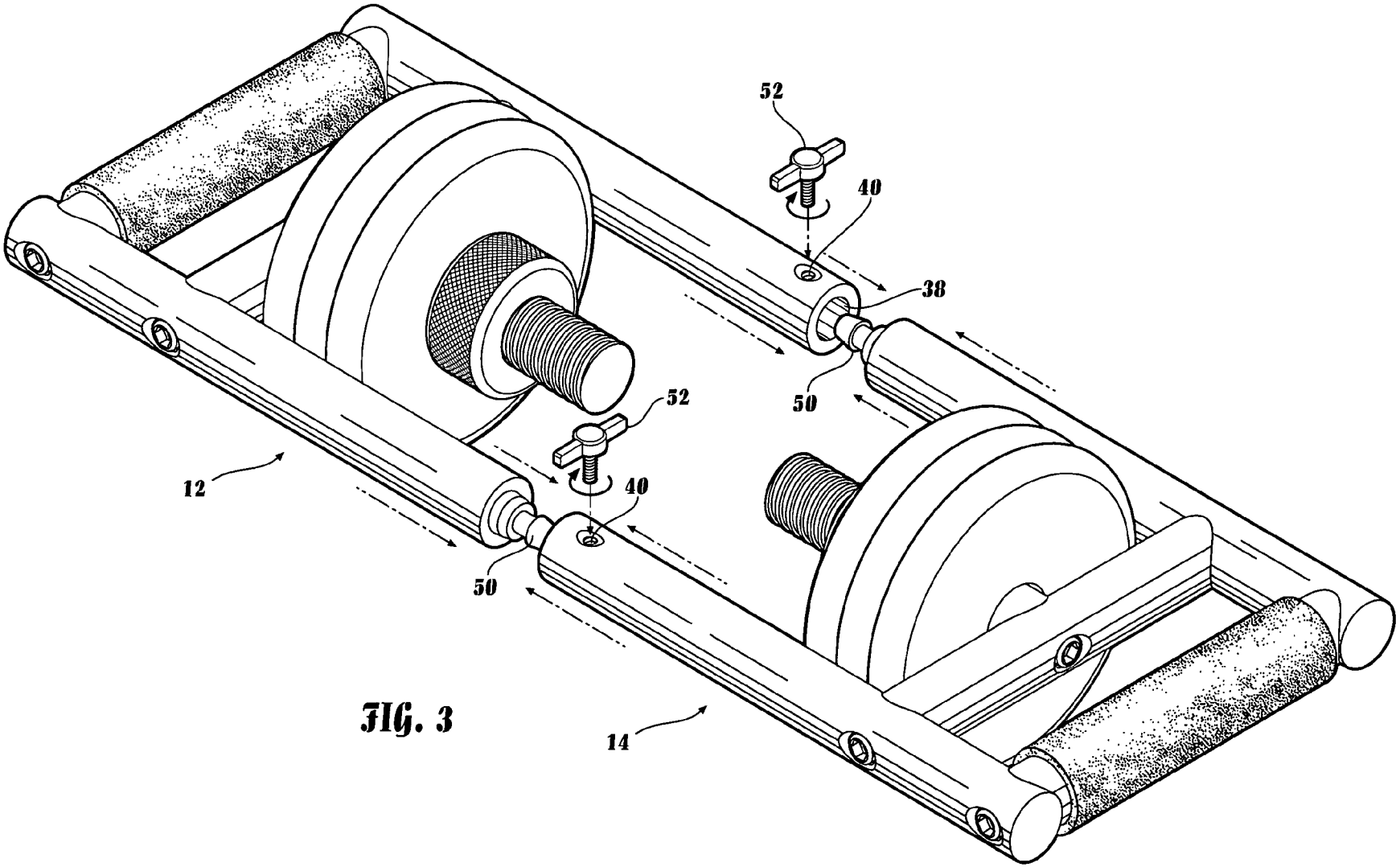
FIG. 3 is an exploded perspective view of the exercise device of FIG. 1 during assembly thereof.

Accordingly, for the exemplary purposes of this disclosure, exercise device 10 may be entirely or partially assembled as depicted in FIGS. 2–3 in the following manner.

First, weight lifting units 12 and 14 are each assembled. For each weight lifting unit, this may include the following steps: placing soft grip overlay 20 over outer crossbar 16; bolting inner crossbar 22 to threaded weight bar 46 by inserting bolt 54 through aperture 26 into threaded aperture 48, wherein inner crossbar 22 and threaded weight bar 46 form an overall T-shape; bolting the ends of outer and inner crossbars 16 and 22 to the end portions of end bars 36 and 46 by inserting bolts 54 through holes 32, 34, 42, and 54 into threaded apertures 18 and 24 respectively; and inserting alignment pin 50 into threaded hole 30 and inserting wing bolt or T-knob 52 partially into threaded hole 40.

At this stage, weights 56 may be removably mounted onto each threaded weight shaft bar 46. This may be accomplished by inserting weight bar 46 through each central through hole 58 of each disc shaped weight 56 and then adjustably coupling threaded weight nut 60 onto threaded weight bar 46 to hold weights 56 in place.

Next or alternatively, weight lifting units 12 and 14 may be assembled together into one, fully assembled weightlifting unit. This may be accomplished by inserting alignment pins 50 into corresponding holes 38 and then inserting wing bolts 52 through holes 40 into the recess in alignment pin 50. Then, if not already installed, weights 56 may be removably mounted onto each threaded weight shaft bar 46 as described previously.

The fully assembled exercise device may be entirely or partially disassembled by reversing the foregoing assembly steps. For example, the one, fully assembled weightlifting unit may be partially taken apart to provide the separate weight lifting units 12 and 14.

While the assembly and disassembly of exercise device 10 has been described in a particular sequence of steps with reference to the drawing figures, it will be understood that the assembly and disassembly of exercise device 10 is not limited to the specific order of steps as disclosed. Any steps or sequence of steps of the assembly and disassembly of exercise device 10 indicated herein are given as examples of possible steps or sequence of steps and not as limitations, since various assembly and disassembly processes and sequences of steps may be used to assemble and disassemble exercise device 10. Other exercise device implementations may be assembled or disassembled in similar manners.

4. Use

Exercise device implementations may be used in a variety of exercises (and exercise variations) for a variety of reasons. For example, exercise device implementations may be used by an exerciser to get in shape, to body build, for rehabilitation after an accident or sickness, and the like. Use of exercise device implementations will make an individual functionally healthy and, if properly used, will work most of the body's major muscle groups. Exercise device implementations are also comfortable to use because they are ergonomically correct weight lifting devices. That is, they fit the body by accommodating the hands of an individual in a normal lifting position, the hands being properly spaced apart.

Many different upper body and lower body weightlifting exercises (along with many exercise variations) may be performed using exercise device implementations, whether fully assembled or split apart into a pair of weightlifting units, such as leg exercises (wide squats, calf raises, stationary lunges, stiff-leg dead lift, reverse lunge, side lunge), back exercises (alternating rows, wide row, dead lift), chest exercises (flat chest press, incline chest press, flat fly, incline fly, decline chest press), arm exercises (standing curls, concentration curls, incline bench curls, Scott curls, overhead triceps extension, triceps kickback, lying triceps extension, hammer curls), shoulder exercises (standing shoulder press, lateral raise, seated overhead press, front raise, upright row, rear delt row, shrugs), and the like.

Figure 6:
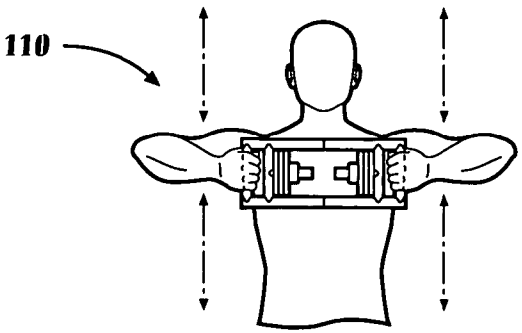
FIGS. 6–7 are perspective views of the exercise device of FIG. 1 during use thereof.
Figure 7:
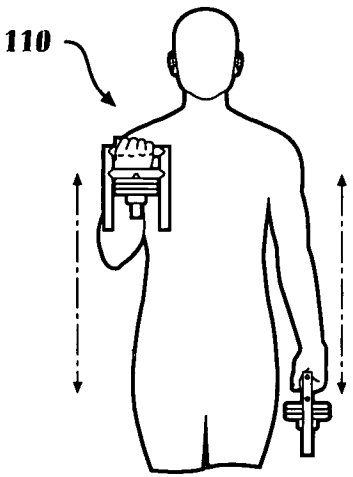
Figure 5:
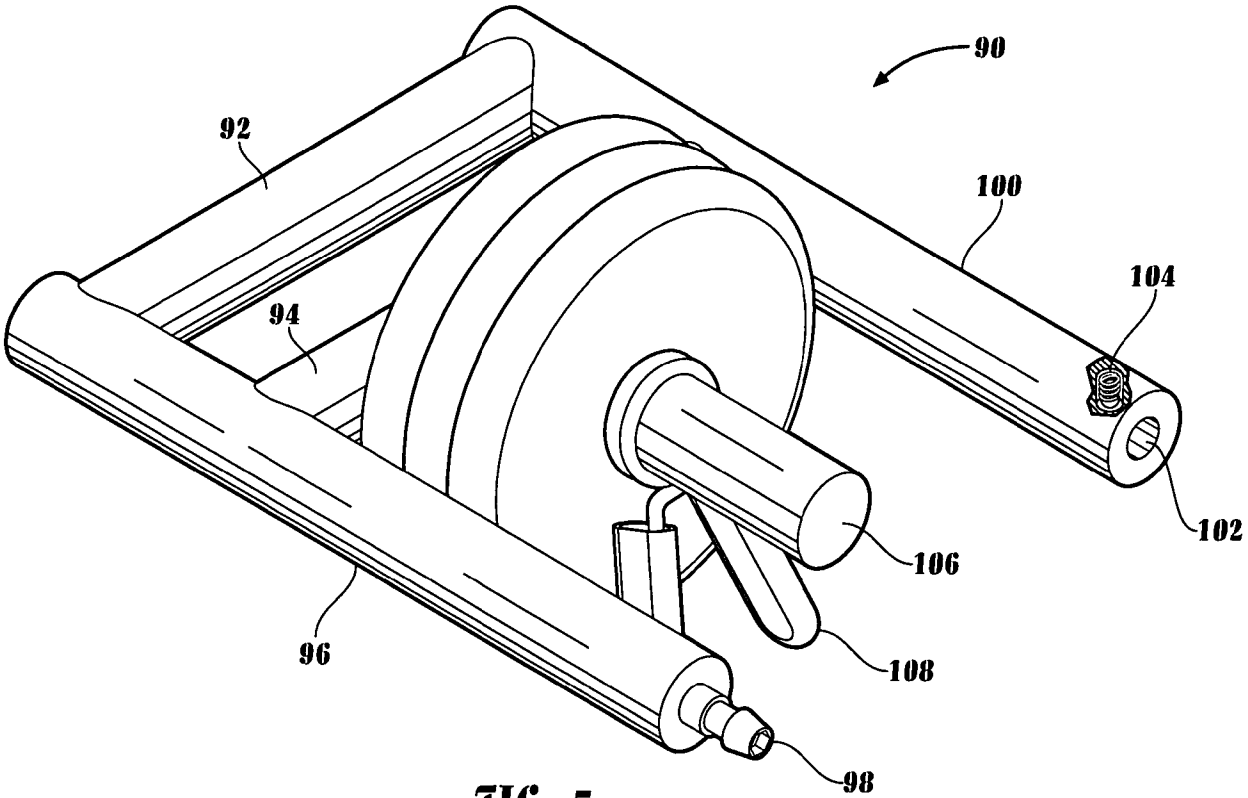
FIG. 5 is a perspective view of one unit of still another exercise device implementation.

Accordingly, in describing the use of exercise device implementations, with reference to FIGS. 6–7 and for the exemplary purposes of this disclosure, exercise device 10 is shown in use by exerciser 110. In FIG. 6, exerciser 110 is using exercise device 10 to accomplish a variation of an upright row. In FIG. 7, exerciser 110 is using units 12 and 14 of exercise device 10 to accomplish standing curls.

The invention claimed is:

1. An exercise device comprising a pair of separate weightlifting units removably coupled to one another, each weightlifting unit comprising:

an outer crossbar configured to serve as a handle, the outer crossbar having central, threaded apertures defined in opposing ends thereof;

an inner crossbar having central, threaded apertures defined in opposing ends thereof, as well as a through hole defined in the middle thereof;

a pair of end bars maintained in a spaced apart, opposing relationship by the outer and inner crossbars, the first end bar having a pair of spaced apart through holes defined in a first end portion thereof and a central threaded aperture defined in a second opposing end thereof, and the second end bar having a pair of spaced apart through holes defined in a first end portion thereof and a central alignment aperture defined in a second opposing end thereof and one of a threaded through hole in communication with the central alignment aperture and a hole in communication with the central alignment aperture;

a weight arm comprised of one of a weight bar, a weight bar threaded along at least a portion of its length, and a weight bar having a plurality of spaced apart holes there through along at least a portion of its length, the weight arm configured to removably hold at least one weight thereon internal to the exercise device, the weight arm extending orthogonally from the inner crossbar, and the weight arm having a central, threaded aperture defined in an end thereof; and at least one weight removably held internal to the exercise device by the weight arm, the at least one weight having a central through aperture;

wherein the outer cross bar, the inner cross bar, the pair of end bars, and the weight arm are removably coupled together.

2. The exercise device of claim 1, further comprising an alignment pin having a threaded base inserted into the central threaded aperture of the first end bar and one of a tapered body having a circumferential recess therein and a non-tapered body having a circumferential recess therein.

3. The exercise device of claim 2 further comprising a winged bolt inserted into the threaded through hole in communication with the central alignment aperture.

4. The exercise device of claim 2 further comprising a ball and spring assembly disposed within the hole in communication with the central alignment aperture, wherein a spring of the assembly is resilient and biases a ball of the assembly into the central alignment aperture.

5. The exercise device of claim 1, wherein the outer cross bar has thereon one of a soft grip overlay, a rotatable sleeve, and a combination thereof.

6. The exercise device of claim 1, wherein the at least one weight is held in place by one of a spring clamp, a pressure ring collar, an adjustable nut, and a pin.

7. The exercise device of claim 6, wherein the weight arm is a weight bar threaded along at least a portion of its length and wherein the at least one weight is held in place by an adjustable nut.

8. The exercise device of claim 7, wherein the adjustable nut is an annularly cylindrical nut having threads on an inner concentric surface and diamond knurl on an outer concentric surface.

9. The exercise device of claim 1, wherein the pair of separate weightlifting units removably coupled to one another comprises an overall rectangular shape.

* * * * *